US006035477A

United States Patent [19]

Robert

[11] Patent Number: 6,035,477

[45] Date of Patent: Mar. 14, 2000

[54] SCRUBBER ATTACHMENT FOR SINK SPRAYER

[75] Inventor: Brenda Robert, Collingswood, N.J.

[73] Assignee: Jokari/US, Inc., Carrollton, Tex.

[21] Appl. No.: 09/079,967

[22] Filed: May 15, 1998

Related U.S. Application Data

[60] Provisional application No. 60/046,572, May 15, 1997.

[51] Int. Cl.[7] ..... A46B 11/00; A46B 13/06

[52] U.S. Cl. ..... 15/29; 15/97.1; 401/289

[58] Field of Search ..... 15/24, 29, 97.1; 239/316, 381; 401/289

[56] References Cited

U.S. PATENT DOCUMENTS

| | | | |
|---|---|---|---|
| 2,748,411 | 6/1956 | O'Brien | 401/289 X |
| 2,807,816 | 10/1957 | O'Brien | 401/289 X |
| 4,254,526 | 3/1981 | Fromm | 15/29 |
| 4,509,221 | 4/1985 | Simpson, Jr. | 15/29 |
| 4,513,466 | 4/1985 | Keddie et al. | 15/29 |
| 4,662,768 | 5/1987 | Gottwald et al. | 401/289 X |
| 4,812,070 | 3/1989 | Marty | 401/289 |

FOREIGN PATENT DOCUMENTS

| | | | |
|---|---|---|---|
| 94/26144 | 11/1994 | WIPO | 15/29 |

*Primary Examiner*—Mark Spisich
*Attorney, Agent, or Firm*—Gilhooly and Crossman, Ltd.

[57] ABSTRACT

Scrubber attachments for a standard sink sprayer having a housing fitting over the sprayer. A rotary or stationary sponge or brush is exteriorly attached to the housing for scrubbing surfaces and items. A soap dispenser is incorporated in the housing for dispensing soap during scrubbing.

10 Claims, 4 Drawing Sheets

FIG. 4
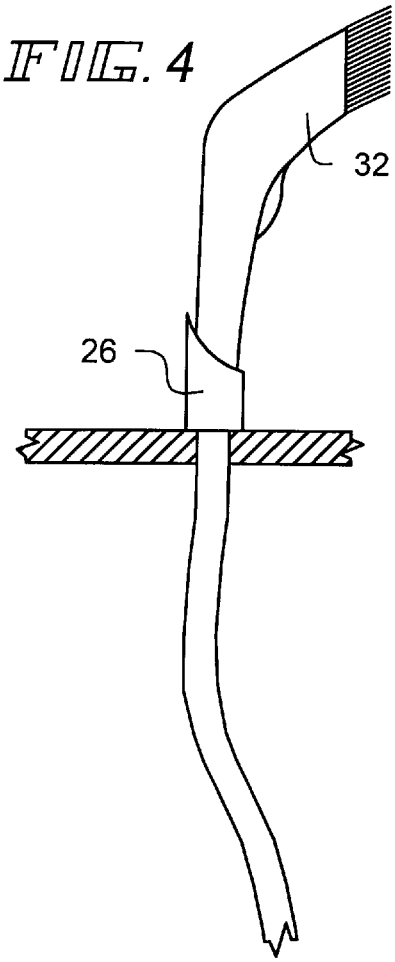
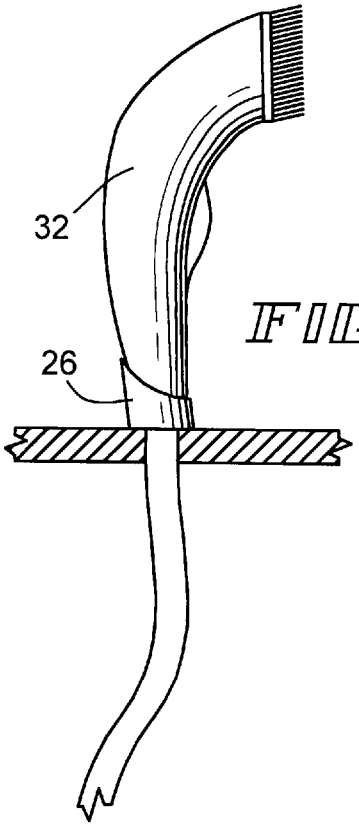
FIG. 5
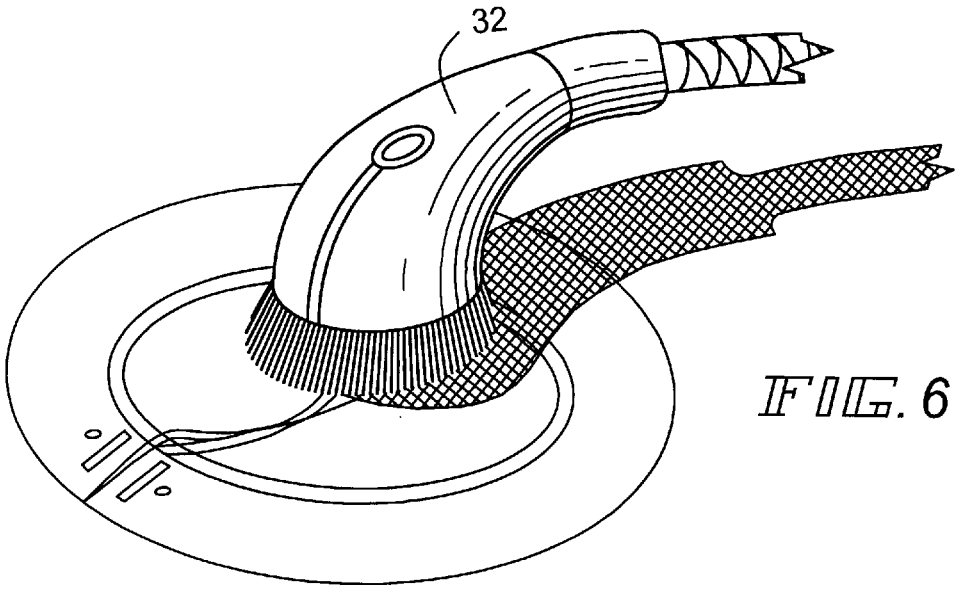
FIG. 6

SCRUBBER ATTACHMENT FOR SINK SPRAYER

This is a non-provisional application relying on the filing date of provisional application, Ser. No. 60/046,572 filed May 15, 1997.

BACKGROUND OF THE INVENTION

1. Field of the Invention

This invention relates in general to sink sprayers and more particularly, to sink sprayers having a scrubber and soap dispenser.

2. Summary of the Prior Art

In the past sink sprayers have become standard accessories for sinks in the kitchen. Such devices provide convenient and effective means for rinsing items and surfaces. Prior sink sprayers have not effectively combined the basic function of rinsing with the capability of being a cleaning device offering the combined effectiveness of a scrubber and a soap dispenser. Known design of articles providing scrubbing and soap dispensing capabilities are also not economically adaptable to existing sprayer heads for transformation to a multi-function capability. Accordingly, it is desirable in the prior art to provide an improved scrubber attachment capable of convenient mounting on a sprayer.

SUMMARY OF THE INVENTION

It is, therefore, an objective of the invention to provide an attachment for a standard sink sprayer which can be snapped on the sprayer to co-act therewith as a scrubber for various items and surfaces; it can be adapted to dispense soap, has a number of different scrubbing features, and can be provided with a stand which allows the scrubber to be in an upright position at the sink ready for easy use. In one embodiment of the invention, the scrubber element is rotatable and is used with a soap dispenser. A second embodiment employs a non-rotary scrubber element and soap dispenser. A third embodiment includes a unique stand for supporting the scrubber attachment herein disclosed.

BRIEF DESCRIPTION OF THE DRAWINGS

The invention, including its design, features and functions are illustrated in the following drawings:

FIG. 4 is a side view of a non-rotary/non-dispensing scrubber with scraping attachment and stand;

FIG. 5 is a side view of a non-rotary/non-dispensing scrubber attachment with vegetable brush attachment and stand;

FIG. 6 is a perspective view of a non-rotary/non-dispensing scrubber with bristle brush attachment shown in use scrubbing a plate;

DESCRIPTION OF THE PREFERRED EMBODIMENTS

Figure 1:
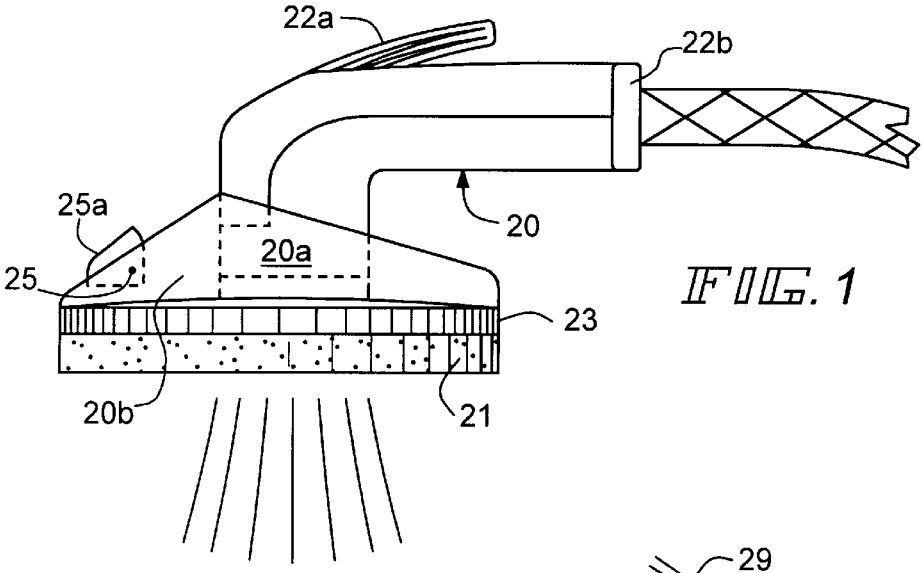
FIG. 1 is a side view of a rotary version of the scrubber and/or scrubbing sponge attachment shown attached to a standard sink sprayer.
Figure 9:
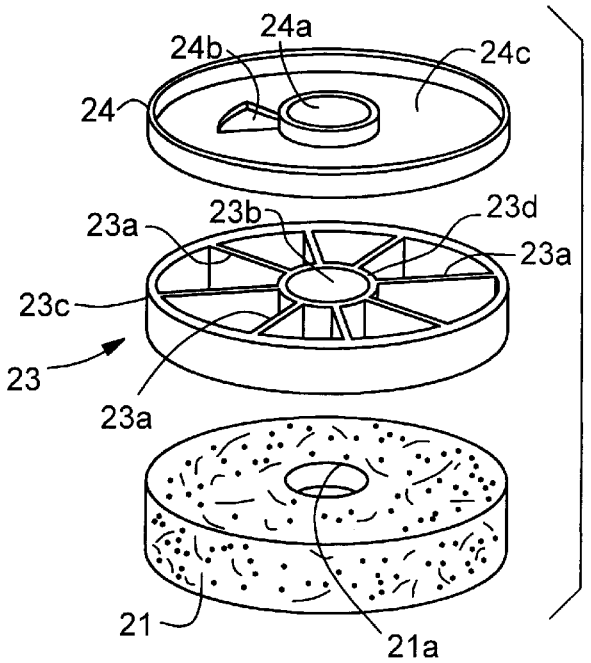
FIG. 9 is a partial front perspective view, with parts exploded, of the scrubber and/or scrubbing sponge attachment of FIG. 1.

Rotary Type Scrubber Attachment with Soap Dispenser and Scrubber Stand—FIG. 1 and FIG. 9

Figure 10:
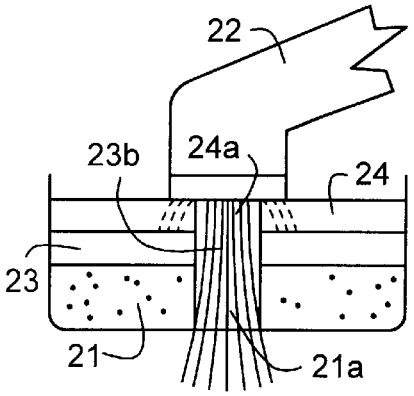
FIG. 10 is a side elevational view with parts in section of the non-rotary version with soap dispenser of FIG. 2.

The plastic rotary style scrubber attachment 20 allows a person to clean an item or surface with the use of a rotary action non-abrasive sponge 21 in the form of a disk. The rotary style scrubber attachment 20 is attached over a standard sink sprayer assembly 22 with hose and spray actuator 22*a* extending outward through an opening in the attachment. The attachment 20 is secured over sink sprayer assembly 22 by ring 22*b*. The scrubber attachment 20 includes a hollow plastic body 20*a* forming a chamber 20*b* over the sink sprayer assembly 22 and a lower outlet portion, such that a generally L-shaped configuration to provide an upper handle and a lower water discharge portion adjacent the non-abrasive sponge 21. The rotary action of the scrubber sponge 21 is powered by the water coming through the standard sink sprayer 22 and into the chamber scrubber 20*b* of attachment 20. This routing of the water creates an effect within the chamber 20 of the attachment and forces the scrubber plate 23 within chamber 20*b* to rotate in a manner as best seen in FIGS. 9 and 10. The scrubber plate 23 is the form of a turbine plastic plate having a series of spaced angular vanes 23*a* and a central vertical hole 23*b*. The vanes 23*a* are secured between an outer ring 23*c* and a tube section 23*d* forming hole 23*b*. A water control plate 24 having central hole 24*a* and a turbine plate inlet slot 24*b* both formed in plate surface 24*c* is mounted in chamber 20*b* in fixed relationship above the rotary turbine plate 23. The sponge 21 having central hole 2 la is affixed to turbine plate 23. The water through sprayer 22 is directed through the central aligned holes, but also through slot 24*b* to cause rotation of the vanes 23*a*. When the water is rerouted through the scrubber attachment it sprays out in a different configuration, and at a different pressure than the standard sink sprayer.

Figure 2:
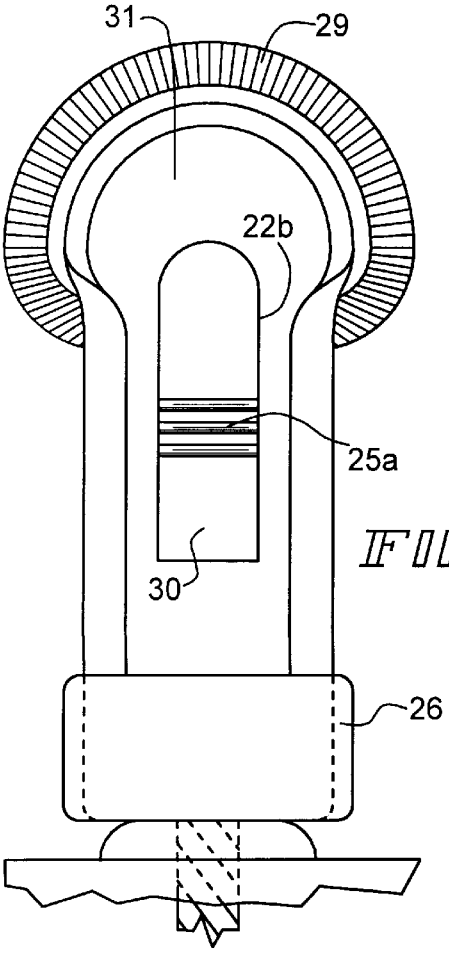
FIG. 2 is a front view of a non-rotary version of the present invention in which the attachment is provided with soap dispensing means and the scrubber is resting in a stand.

The body of the scrubber is contoured to fit easily into a person's hand. The soap dispensing chamber 25 of the scrubber chamber 20*a* holds liquid soap, and the output of the soap is controlled by a button 25*a* that the consumer actuates. The button 25*a* may be connected to rod 25*b* and valve 25*c* to open an orifice 25*d* on the bottom wall. The scrubber attachment also has a stand 26 such as shown in FIG. 2 which sits at the base of the sink, where the standard sink sprayer hose comes out. This allows the scrubber to be in an upright position at the sink ready for use.

Figure 3:
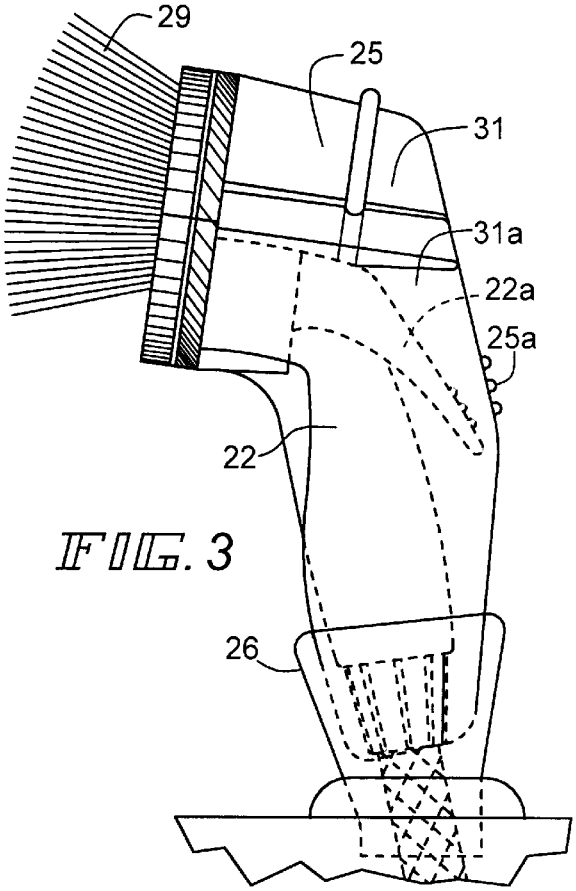
FIG. 3 is a see-through side view of a non-rotary type/soap dispensing scrubber with stand.
Figure 7:
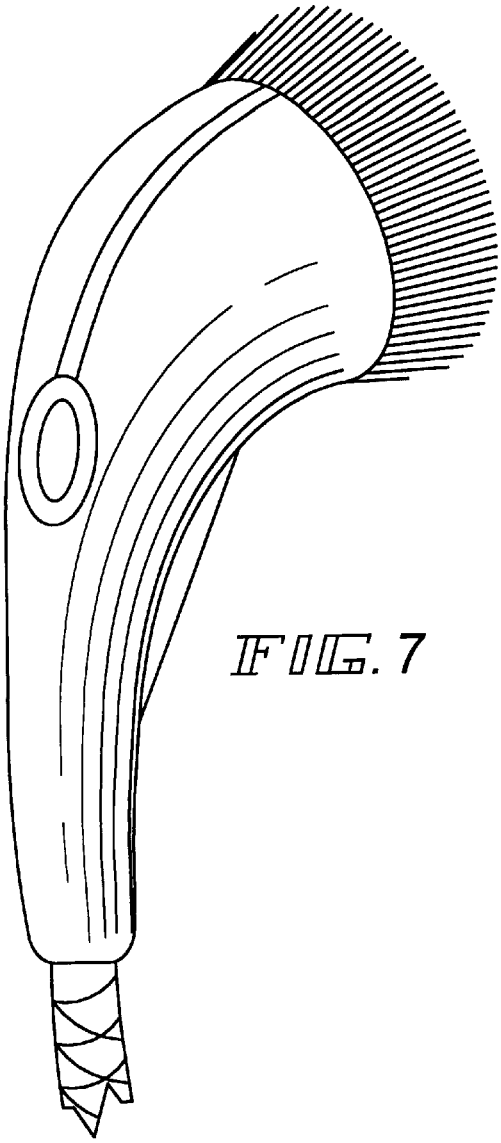
FIG. 7 is a perspective view of a non-rotary/non-dispensing scrubber with vegetable brush attachment.
Figure 8:
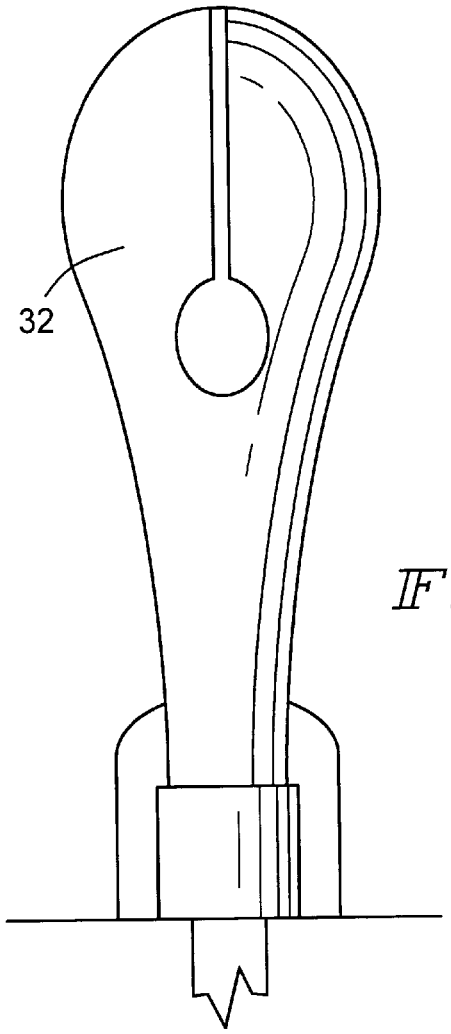
FIG. 8 is a front view of a non-rotary/non-dispensing scrubber with stand.

This embodiment can be equipped with a bristle brush of the type identified as 27 in FIG. 3 or a vegetable brush feature adapted particularly for cleaning potatoes and mushrooms identified as 29 in FIG. 7.

Figure 11:
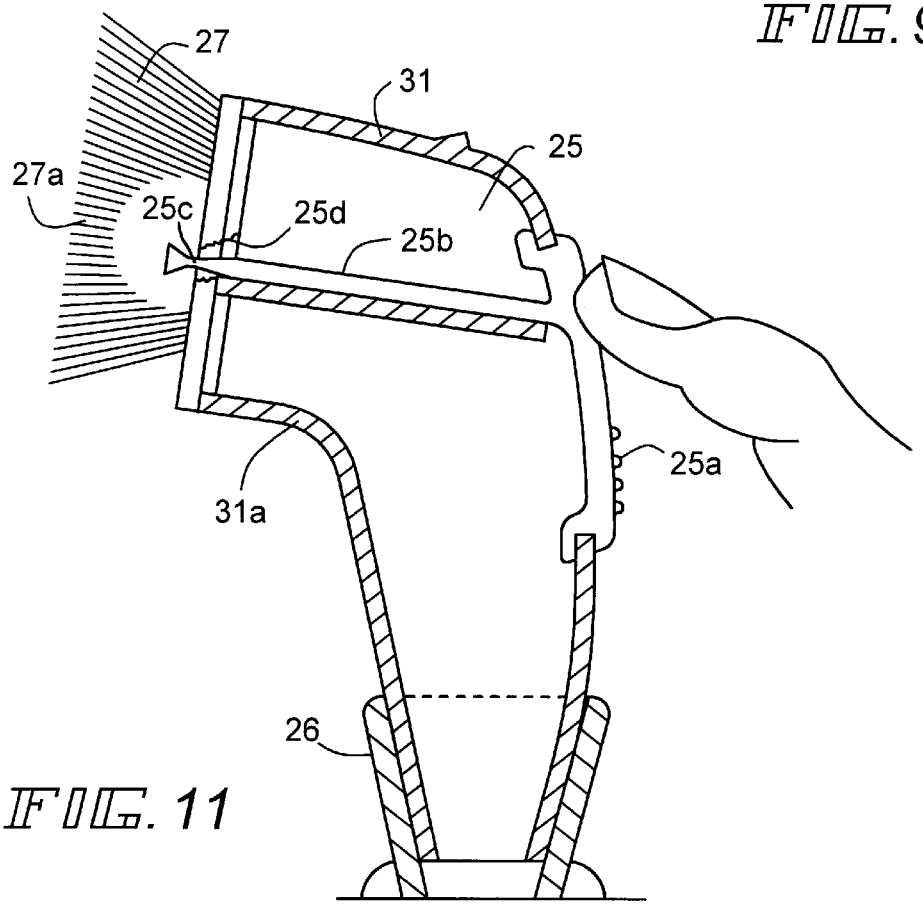
FIG. 11 is a partial side elevational view of FIG. 10.

Non-Rotary Type Scrubber Attachment with Soap Dispenser and Scrubber Stand—FIGS. 2, 3 and 11

The plastic non-rotary style scrubber attachment 31 allows a person to clean an item or surface with the use of a scrubber attachment containing a stationary bristle brush 27 having a central flow opening 27*a* (FIG. 11). The scrubber body 31*a* attaches to the body of a standard sink sprayer 22 in surrounding relationship and is contoured to fit easily into a person's hand. The water running through the standard sink sprayer 22 is not interrupted by the scrubber attachment by flow through flow opening 27*a*, and spray actuator 22*a* of sprayer 22 is accessible through opening 30 of scrubber body 31*a* in a similar manner as in FIG. 1. It should be apparent that actuator 22*a* may be in a position to extend outward as in FIG. 1. There is a chamber 25 separated by suitable walls designed into the scrubber attachment that dispenses liquid soap as best seen in FIG. 11. The dispensing of the liquid soap is controlled by the button 25*a* that the user actuates. As seen in FIG. 11, the button 25*a* is depressible to move rod 25*b* and valve 25*c* and uncover orifice 25*d*. The soap in soap compartment 25 then is able by gravity to flow into brush 27. The scrubber attachment 31 also has a stand 26 which sits at the base of the sink, where the standard sink sprayer hose comes out. This allows the scrubber to be in an upright position at the sink ready for the consumer to easily grasp and use. The scrubbing attachment can be provided with a non-abrasive sponge and/or standard sponge 21.

Non-Rotary Type Scrubber Attachment with Stand Only—FIGS. 4, 5, 6, 7 and 8

The non-rotary style scrubber 32 allows a person to clean an item or surface with the use of a scrubber attachment containing a stationary bristle brush 27. The scrubber attaches to the body of a standard sink sprayer 22, and is contoured to fit easily into a person's hand. The water running through the standard sink sprayer 22 is not interrupted by the scrubber attachment. This scrubber is unique in that it does not dispense soap. It still incorporates the stand 26 which sets at the base of the sink where the standard sink sprayer hose comes out. This allows the scrubber to be in an upright position at the sink ready for the user to easily grasp and use. As with the other embodiments, the scrubber may be equipped with the non-abrasive sponge and/or standard sponge 21, the vegetable brush for potatoes or mushrooms 29, and/or the scraper (not shown).

What is claimed is:

1. A scrubber attachment for a sink water sprayer having a nozzle portion and a handle portion transversely extending therefrom with a hose extending from the handle portion for supplying water thereto and for spraying water through use of an actuator located on the handle portion of the water sprayer, said scrubber attachment comprising:

a scrubber body having an open end for receiving the water sprayer;

said scrubber body supporting an external scrubber element;

said scrubber body being hollow and substantially surrounding the handle and nozzle portions of the water sprayer when mounted thereon, said scrubber body forming a chamber having a first section adapted to fit over and surround the handle portion of the water sprayer and a second section transversely extending from said first section at a bend in the scrubber body which is adapted to fit over and surround the nozzle portion of the water sprayer so as to direct water from the water sprayer adjacent said scrubber element, the first section of the scrubber body having a top access opening to provide access to the actuator of the sink water sprayer.

2. The scrubber attachment according to claim 1 wherein said scrubber element is a brush.

3. The scrubber attachment according to claim 1 wherein said scrubber element is a sponge.

4. The scrubber attachment according to claim 1 wherein said scrubber body includes soap dispenser means for dispensing soap from said scrubber body.

5. The scrubber attachment according to claim 4 wherein said soap dispenser means dispenses soap through said scrubber element.

6. The scrubber attachment according to claim 5 wherein said soap dispenser means includes an external actuator.

7. The scrubber attachment according to claim 1 further comprising means for rotating said scrubber element.

8. The scrubber attachment according to claim 7 wherein said means for rotating said scrubber element is rotated by water flow.

9. The scrubber attachment according to claim 8 wherein said means for rotating said scrubber element includes a turbine plate having an outer circular ring, a central tube and a plurality of angular arranged vanes, said vanes being secured between said outer circular ring and said central tube, a water control plate mounted above said turbine plate, said water control plate having an opening aligned with said central tube and an open slot aligned with said plurality of vanes.

10. The scrubber attachment according to claim 1 further including stand means for supporting said scrubber body in an upright orientation.

* * * * *